US010144056B2

(12) United States Patent
Aoki

(10) Patent No.: US 10,144,056 B2
(45) Date of Patent: Dec. 4, 2018

(54) SELF-HARDENING MOLD-MAKING APPARATUS

(71) Applicant: SINTOKOGIO, LTD., Nagoya-shi, Aichi (JP)

(72) Inventor: Yukinori Aoki, Fukuoka (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/313,172

(22) PCT Filed: Apr. 6, 2015

(86) PCT No.: PCT/JP2015/060752
§ 371 (c)(1),
(2) Date: Nov. 22, 2016

(87) PCT Pub. No.: WO2015/182250
PCT Pub. Date: Dec. 3, 2015

(65) Prior Publication Data

US 2017/0189956 A1 Jul. 6, 2017

(30) Foreign Application Priority Data

May 27, 2014 (JP) ..... 2014-109306

(51) Int. Cl.
*B22C 15/10* (2006.01)
*B22C 5/12* (2006.01)
(Continued)

(52) U.S. Cl.
CPC ..... *B22C 15/10* (2013.01); *B22C 5/0472* (2013.01); *B22C 5/12* (2013.01); *B22C 5/16* (2013.01);
(Continued)

(58) Field of Classification Search
CPC ..... B22C 15/10; B22C 15/12; B22C 15/16; B22C 15/02; B22C 15/28; B22C 19/04; B22C 5/0472; B22C 5/12; B22C 5/16
See application file for complete search history.

(56) References Cited

U.S. PATENT DOCUMENTS 3,912,238 A 10/1975 Richard

FOREIGN PATENT DOCUMENTS

CN 1242272 1/2000
CN 101011727 8/2007
(Continued)

OTHER PUBLICATIONS

English machine translation JPH04094839.*
International Preliminary Report on Patentability dated Dec. 8, 2016 for PCT/JP2015/060752.

*Primary Examiner* — Kevin P Kerns
*Assistant Examiner* — Steven S Ha
(74) *Attorney, Agent, or Firm* — Drinker Biddle & Reath LLP

(57) ABSTRACT

Teaching storage means stores teaching data created on the basis of signals from a first pulse generator, a first shaft detector, a second pulse generator, and a second shaft detector, in a storage unit as a sequence control program of molding operation of a self-hardening mold when teaching operation of throwing kneaded self-hardening foundry sand from a discharge port into a molding flask is performed by manually moving a conveyor arm and a kneading arm. Molding playback means reads out the sequence control program from the storage unit to control and drive a first pivot motor and a second pivot motor on the basis of the sequence control program to pivot the conveyor arm and the kneading arm, and then throws the self-hardening foundry
(Continued)

sand from the discharge port of the kneading arm into the molding flask to reproduce the molding operation.

5 Claims, 9 Drawing Sheets

(51) Int. Cl.

| | |
|---|---|
| ***B22C 19/04*** | (2006.01) |
| ***B22C 15/02*** | (2006.01) |
| ***B22C 15/28*** | (2006.01) |
| ***B22C 5/04*** | (2006.01) |
| ***B22C 5/16*** | (2006.01) |

(52) U.S. Cl.
CPC ..... *B22C 15/02* (2013.01); *B22C 15/28* (2013.01); *B22C 19/04* (2013.01)

(56) References Cited

FOREIGN PATENT DOCUMENTS

| | | | |
|---|---|---|---|
| CN | 10200076 | | 4/2011 |
| CN | 202155470 | | 3/2012 |
| CN | 203235892 | | 10/2013 |
| CN | 203565783 | | 4/2014 |
| DE | 2257198 | | 5/1974 |
| GB | 1 299 093 | | 12/1972 |
| JP | S59/205282 | A | 11/1984 |
| JP | S61-97346 | U | 6/1986 |
| JP | H03-106569 | A | 5/1991 |
| JP | H04-94839 | A | 3/1992 |
| TW | 200836855 | | 9/2008 |
| TW | 201233463 | | 8/2012 |

* cited by examiner

SELF-HARDENING MOLD-MAKING APPARATUS

TECHNICAL FIELD

One aspect and embodiments of the present invention relate to a self-hardening molding apparatus that manufactures a mold by filling a molding flask with self-hardening foundry sand.

BACKGROUND ART

There is known a self-hardening molding apparatus that drops self-hardening foundry sand kneaded by adding a hardener and a binder into foundry sand into a molding flask so that the molding flask is filled with the self-hardening foundry sand to be hardened to form a mold without passing through a drying process.

When a relatively large mold is formed by using this kind of self-hardening molding apparatus, there is a risk that the self-hardening foundry sand does not uniformly fill throughout the pattern if the kneaded self-hardening foundry sand is simply thrown into a molding flask including the pattern. As a result, a cavity or the like may be generated to fail to accurately form a mold.

Thus, when a relatively large mold is formed by using a self-hardening molding apparatus, a veteran technician operates the molding apparatus to properly move a discharge port of foundry sand above a molding flask and level foundry sand while leveling self-hardening foundry sand to uniformly fill throughout the pattern with the self-hardening foundry sand to form a mold. For that, when a relatively large mold is formed by using this kind of self-hardening molding apparatus, a veteran technician must be needed. Thus, it is difficult to widely form molds with an enough amount of production in many companies that lack veteran technicians.

For this reason, Patent Literature 1 described below has proposed a self-hardening molding machine capable of automatic operation. This conventional self-hardening molding machine includes first and second arms for kneading and supplying self-hardening foundry sand, the first and second arms being pivotally controlled by a servo motor of a driving system. When these arms are used, a veteran technician first throws the self-hardening foundry sand into a molding flask while manually moving the arms without using the driving system. Then, pulses generated from a rotary encoder attached to each of the arms, in response to movement of each of the arms, are counted to store the number of pulses indicating a rotation angle of each of the arms in a storage device.

At the time of automatic operation, the number of pulses indicating the rotation angle of each of the arms is read out from the storage device, and then the servo motor is controlled and driven on the basis of the number of pulses to automatically rotate the first and second arms. Subsequently, the self-hardening foundry sand is thrown from a discharge port provided at a leading end of the second arm into the molding flask.

CITATION LIST

Patent Literature

Patent Literature 1: Japanese Unexamined Patent Publication No. H4-94839

SUMMARY OF INVENTION

Technical Problem

Unfortunately, this conventional self-hardening molding machine drives the first and second arms to reproduce molding operation on the basis of data stored when a veteran technician first manually performs the molding operation. When the molding machine is operated by such automatic control, data to be used for reproduction is only the number of pulses that has been simply counted. This causes an error in position control of the discharge port provided at the leading end of the second arm due to voltage fluctuation of a driving motor, variation of frictional resistance with variation of viscosity of lubricant, or the like, in a mechanical driving system in a driving unit of the first and second arms. That is, if there is voltage fluctuation of a power source of the driving motor, variation of frictional resistance with variation of viscosity of the lubricant, or the like, in the driving unit of the first and second arms, even the same command signal supplied to a servo system of the driving motor at the same time causes an error in the position control of the discharge port.

Such an error of position control of the discharge port moved by automatic control is accumulated for each rotation of the arms. Increase in the error may cause the discharge port automatically controlled to be positioned outside the molding flask, and thus there is not only a problem in which molding operation performed by a veteran technician manually cannot be accurately reproduced, but also a problem in which operation itself of forming a mold cannot be performed.

The present technical field desires a self-hardening molding apparatus capable of accurately reproducing molding operation on the basis of data stored during teaching.

Solution to Problem

A self-hardening molding apparatus in accordance with one aspect of the present invention throws self-hardening foundry sand kneaded by adding a hardener and a binder into foundry sand into a molding flask so that the molding flask is filled with the self-hardening foundry sand to be hardened to form a mold. The self-hardening molding apparatus include: a conveyor arm that is pivotally supported around a pivot and has a conveyor for feeding the foundry sand; a first pivot motor that pivotally drives the conveyor arm; a first pulse generator that generates a pulse signal in accordance with rotation of the first pivot motor; a first shaft detector that includes a plurality of detection switches for generating an angle detection signal indicating a pivot angle when the conveyor arm is pivoted; a kneading arm that is pivotally attached around a pivot at a leading end of the conveyor arm to receive the foundry sand fed by the conveyor in the conveyor arm, and then feeds the foundry sand to a leading end of the kneading arm while kneading the foundry sand together with the hardener and the binder to discharge the kneaded self-hardening foundry sand from a discharge port provided at the leading end of the kneading arm; a second pivot motor that pivotally drives the kneading arm with respect to the conveyor arm; a second pulse generator that generates a pulse signal in accordance with rotation of the second pivot motor; a second shaft detector that includes a plurality of detection switches for generating an angle detection signal indicating a pivot angle when the kneading arm is pivoted; teaching storage means for performing teaching storage operation of storing teaching data created on the basis of signals from the first pulse generator, the first shaft detector, the second pulse generator, and the second shaft detector when teaching operation of throwing the kneaded self-hardening foundry sand from the discharge port into the molding flask is performed by moving the conveyor arm and the kneading arm manually, the teaching data being stored in a storage unit as a sequence control program of molding operation of a self-hardening mold; and molding playback means for performing molding playback operation to perform the molding operation of a self-hardening mold by reading out the sequence control program from the storage unit to control and drive the first pivot motor and the second pivot motor on the basis of the sequence control program. The teaching storage means or the molding playback means calculates a rotation angle of the conveyor arm or the kneading arm by counting the pulse signal outputted from the first pulse generator or the second pulse generator from a starting point at which the angle detection signal to be outputted from each of the first shaft detector and the second shaft detector is generated, thereby performing the teaching storage operation or the molding playback operation.

According to the self-hardening molding apparatus, the rotation angle of the conveyor arm or the kneading arm is calculated at the time of the teaching storage operation or the molding playback operation by counting the pulse signal outputted from the first pulse generator or the second pulse generator from the starting point at which the angle detection signal to be outputted from the first shaft detector and the second shaft detector is generated. This allows the conveyor arm or the kneading arm to be pivoted to move the discharge port to correct rotation angle data in accordance with the pulse signal outputted from the first pulse generator or the second pulse generator every time when the angle detection signal to be outputted from the first shaft detector or the second shaft detector is generated. As a result, an error in position control of the discharge port is not accumulated for each rotation of the arms unlike a conventional one, and thus the molding operation can be accurately and properly reproduced on the basis of the teaching data stored during the teaching storage operation.

In one embodiment, the plurality of detection switches of the first shaft detector and the plurality of detection switches of the second shaft detector may be disposed to allow each of at least one of the plurality of detection switches of the first shaft detector and at least one of the plurality of detection switches of the second shaft detector to generate the angle detection signal when the discharge port is moved to a central portion of the molding flask. This allows the rotation angle data based on the pulse signal outputted from the first pulse generator or the second pulse generator to be frequently corrected in the central portion in the molding flask where the discharge port provided at the leading end of the kneading arm frequently passes through when the self-hardening foundry sand is thrown, and thus the molding operation can be more accurately reproduced.

Another embodiment may further include a vibratory table for vibrating the molding flask. The vibratory table may vibrate the molding flask while the self-hardening foundry sand is thrown from the discharge port provided at the leading end of kneading arm to achieve dense filling with the self-hardening foundry sand during the teaching storage operation or the molding playback operation.

In yet another embodiment, the teaching storage means may store teaching polar coordinates data indicating polar coordinates of moved positions of the discharge port in the storage unit as the sequence control program on the basis of signals from the first pulse generator, the first shaft detector, the second pulse generator, and the second shaft detector, during the teaching storage operation, and the molding playback means may reproduce the molding operation of a self-hardening mold on the basis of the teaching polar coordinates data stored in the storage unit, during the molding playback operation. This enables the molding playback operation to be accurately and properly reproduced.

Yet another embodiment may further include display means for displaying coordinates of moved positions of the discharge port. The conveyor arm and the kneading arm are pivotally supported in a horizontal plane to form a horizontal biaxial rotation mechanism. The horizontal biaxial rotation mechanism is operated to set XY-coordinates in the molding flask being a range of movement of the discharge port, and then the display means may display coordinates of moved positions of the discharge port on the basis of the teaching polar coordinates data converted into XY-coordinates.

This enables a movement locus of the discharge port to be graphically displayed in XY-coordinates displayed in a display of a control panel or the like on the basis of the teaching polar coordinates data converted into XY-coordinates. Thus, an operator can easily visually recognize movement of the discharge port in the molding operation during teaching storage operation or playback operation (reproduction) while viewing the graphic display.

As the display means above, a liquid crystal display (LCD), a touch panel display including an input function, and the like are available.

Advantageous Effects of Invention

According to the one aspect and the embodiments of the present invention, the molding operation can be accurately and properly reproduced on the basis of the teaching data stored during teaching.

DESCRIPTION OF EMBODIMENTS

Figure 1:
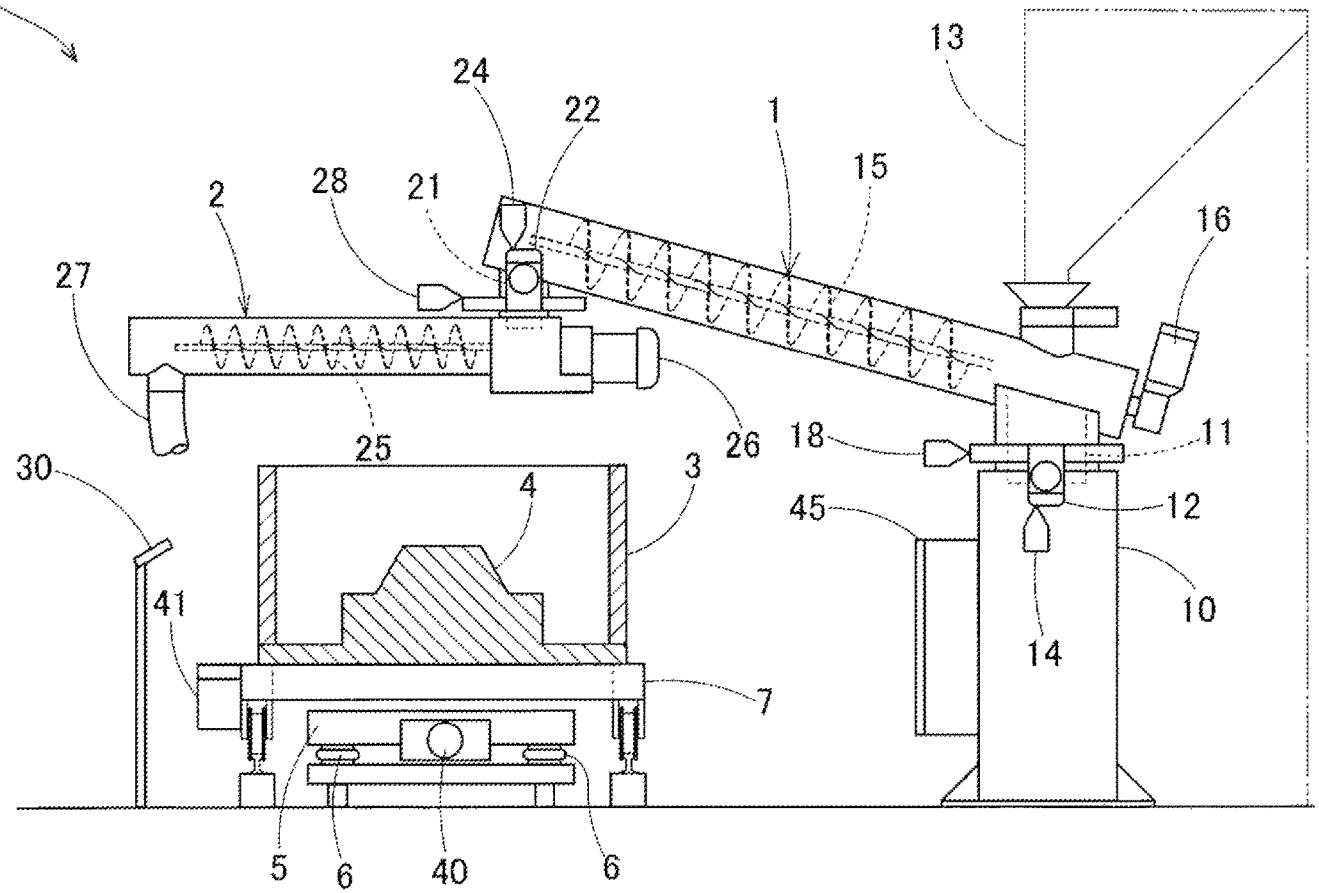
FIG. 1 is a front view showing schematic structure of a self-hardening molding apparatus in accordance with one embodiment of the present invention.

Hereinafter, embodiments of the present invention will be described with reference to drawings. A self-hardening molding apparatus 100 shown in FIGS. 1 and 2 throws self-hardening foundry sand kneaded by adding a hardener and a binder into foundry sand into a molding flask 3 so that the molding flask 3 is filled with the self-hardening foundry sand to be hardened to form a mold As shown in FIG. 1, a pattern 4 for forming a mold is accommodated in the molding flask 3. The molding flask 3 is mounted on a carriage 7 to be driven by a conveying motor 41, and is fed to a predetermined molding position. A vibratory table 5 is provided below the carriage 7, the vibratory table 5 being moved up and down by a lift 6 of an air damper type. The vibratory table 5 is provided with a vibratory device that is to be vibrated by rotation of a vibration motor 40 to vibrate the molding flask 3. The vibratory table 5 provided with the vibratory device is moved up by the lift 6 of an air damper type when supply of foundry sand into the molding flask 3 is completed, and then is brought into contact with a lower surface of the pattern 4 positioned immediately above the vibratory table 5 to apply vibration to the molding flask 3 on the pattern 4. This allows dense filling with the foundry sand to be achieved.

Figure 2:
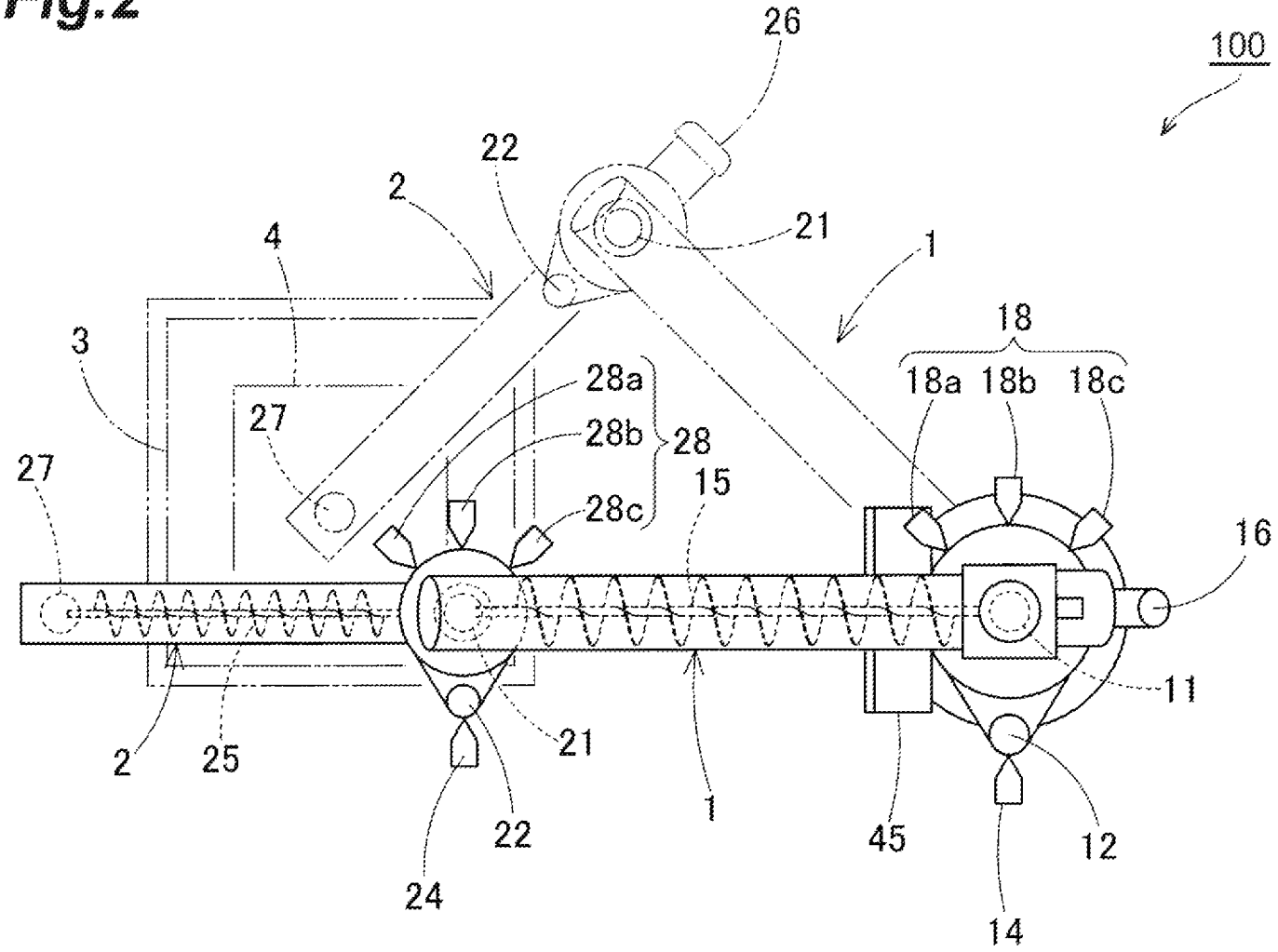
FIG. 2 is a plan view showing schematic structure of the self-hardening molding apparatus.

As shown in FIGS. 1 and 2, the self-hardening molding apparatus 100 includes: a conveyor arm 1 that is pivotally supported around a first pivot 11 and has a conveyor for feeding foundry sand provided in an arm section; a first pivot motor 12 that pivotally drives the conveyor arm 1 around the first pivot 11; a first pulse generator 14 that generates a pulse signal in accordance with rotation of the first pivot motor 12; and a first shaft detector 18 having a detection switch that generates an angle detection signal indicating a predetermined angle (pivot angle) when the conveyor arm 1 is pivoted through the predetermined angle.

At a leading end of the conveyor arm 1, a kneading arm 2 is supported to be able to pivot in a horizontal plane through the second pivot 21. The kneading arm 2 is configured as follows. That is, the kneading arm 2 is pivotally attached around the second pivot 21. The kneading arm 2 receives foundry sand fed by a screw conveyor 15 in the conveyor arm 1, and then a kneading screw 25 provided inside the kneading arm 2 is rotationally driven by a kneading motor 26 to feed the foundry sand to a leading end of the kneading arm 2 while kneading the foundry sand together with a hardener and a binder. The kneading arm 2 then discharges the kneaded self-hardening foundry sand from a discharge port 27 provided at the leading end of the kneading arm 2. In the self-hardening molding apparatus 100, the kneading arm 2 and the conveyor arm 1 form a horizontal biaxial oscillation mechanism. The kneading arm 2 and the conveyor arm 1 are controlled to be pivoted to manually or automatically move the discharge port 27 to a suitable position in the molding flask 3.

The conveyor arm 1 is supported to be able to pivot in a horizontal plane through the first pivot 11 vertically supported by a pivot support part 10 erected on a floor. The conveyor arm 1 includes an arm section in which the screw conveyor 15 is provided. As shown in FIGS. 1 and 2, the conveyor arm 1 is supported to be able to pivot in a range within a predetermined angle around the first pivot 11 by drive of the first pivot motor 12. The conveyor arm 1 is inclined so that the leading end of the conveyor arm 1 is positioned slightly above a base portion of the conveyor arm 1 on a first pivot 11 side. A feeding duct for feeding foundry sand to the kneading arm 2 is connected to the leading end of the conveyor arm 1. The pivot support part 10 erected on the floor includes a control panel 45 attached to its side portion.

The first pivot motor 12 includes a rotation shaft provided with the first pulse generator 14 that generates pulse signals in accordance with a rotation angle of the first pivot motor 12. The pulse signals generated and outputted by the first pulse generator 14 are transmitted to a programmable logic controller 30 described later. The programmable logic controller 30 includes a microcomputer 31 that counts the pulse signals to calculate a rotation angle of the conveyor arm 1.

Likewise, a second pivot motor 22 pivotally drives the kneading arm 2 around the second pivot 21, and includes a rotation shaft provided with a second pulse generator 24 that generates pulse signals in accordance with a rotation angle of the second pivot motor 22. The microcomputer 31 of the programmable logic controller 30 counts the pulse signals generated and outputted by second pulse generator 24 to calculate a rotation angle of the kneading arm 2. The microcomputer 31 calculates position data indicating a position of the discharge port 27 provided at the leading end of the kneading arm 2 in the molding flask as polar coordinates data indicated by polar coordinates from rotation angle data indicating a rotation angle (angle position) of the conveyor arm 1, rotation angle data indicating a rotation angle (angle position) of the kneading arm 2, and arm length data on each of the arms.

In the periphery of the first pivot 11 of the conveyor arm 1, the first shaft detector 18 is provided to output an angle detection signal when a rotation angle of the conveyor arm 1 reaches a predetermined angle. The first shaft detector 18 includes three detection switches of a first limit switch 18*a*, a second limit switch 18*b*, and a third limit switch 18*c*, as a plurality of detection switches, the three detection switches being disposed 45° apart from each other, for example. The first limit switch 18*a* outputs an angle detection signal indicating an angle of 0° of the conveyor arm 1 when the conveyor arm 1 is positioned at an original point. The second limit switch 18*b* outputs an angle detection signal indicating an angle of 45° of the conveyor arm 1 when the conveyor arm 1 is turned through 45° in a clockwise direction in FIG. 2. The third limit switch 18*c* outputs an angle detection signal indicating an angle of 90° of the conveyor arm 1 when the conveyor arm 1 is turned through 90° in the clockwise direction in FIG. 2.

The angle detection signals each to be outputted from the first limit switch 18*a*, the second limit switch 18*b*, and the third limit switch 18*c*, of the first shaft detector 18, are to be outputted as a reference signal indicating an absolute angle of the conveyor arm 1. The angle detection signal of the first shaft detector 18 is used to correct a rotation angle calculated from a count value of pulse signals outputted from the first pulse generator 14 in accordance with a rotation angle of the first pivot motor 12.

When the discharge port 27 is positioned in a central portion of the molding flask 3, a rotational position of the conveyor arm 1 is set as an original point position, and then the first shaft detector 18 may be set to turn on any one of the first limit switch 18*a*, the second limit switch 18*b*, and the third limit switch 18*c*, when a rotational position of the conveyor arm 1 reaches the original point position. This enables the central portion of the molding flask 3 where the discharge port 27 frequently passes through during molding operation to be set as the original point position of the conveyor arm 1. As a result, rotation angle data on the conveyor arm 1 based on a count value of pulse signals outputted from the first pulse generator 14 can be corrected with high frequency by using an angle detection signal of the first shaft detector 18, and thus accuracy of the rotation angle data on the conveyor arm 1 can be increased.

As shown in FIG. 2, the present embodiment allows the first limit switch 18*a*, the second limit switch 18*b*, and the third limit switch 18*c* to be disposed 45° apart from each other. Then, in a rotational position every 45° including the original point position of the conveyor arm 1, an angle detection signal in accordance with a rotation angle of the rotational position is outputted. However, a rotational position for outputting an angle detection signal may be set only at the original point position and a rotational position at 450. Alternatively, the angle detection signal may be outputted at rotational positions at fine angles including the original point position, such as 30°, 60°, and 90°, 20°, 40°, and 60°, and 10°, 20°, and 30°. In addition, instead of the limit switch, a proximity switch, a photoelectric switch, or the like may be used as the detection switch.

Meanwhile, a conveyor motor 16 is attached to the base portion of the conveyor arm 1. The screw conveyor 15 in the arm section of the conveyor arm 1 is rotationally driven by the conveyor motor 16. As shown in FIG. 1, a sand hopper 13 is connected to the base portion of the conveyor arm 1 to supply foundry sand into the conveyor arm 1. The foundry sand supplied from the sand hopper 13 is fed toward the leading end of the conveyor arm 1 by rotation of the screw conveyor 15. As described above, the kneading arm 2 is supported at the leading end of the conveyor arm 1 to be able to pivot in a horizontal plane through the second pivot 21. A feeding duct for feeding foundry sand to the kneading arm 2 on a leading end side of the conveyor arm 1 is connected between the conveyor arm 1 and the kneading arm 2.

As shown in FIG. 2, as with the conveyor arm 1, a second shaft detector 28 is provided in the periphery of the second pivot 21 of the kneading arm 2 to output an angle detection signal indicating an angle (pivot angle) of the kneading arm 2 when a rotation angle of the kneading arm 2 reaches a predetermined angle. The second shaft detector 28 includes three detection switches of a first limit switch 28*a*, a second limit switch 28*b*, and a third limit switch 28*c*, as a plurality of detection switches, the three detection switches being disposed 45° apart from each other, for example. The first limit switch 28*a* outputs an angle detection signal indicating an angle of 0° of the kneading arm 2 when the kneading arm 2 is positioned at an original point. The second limit switch 28*b* outputs an angle detection signal indicating an angle of 45° of the kneading arm 2 when the kneading arm 2 is turned through 45° in the clockwise direction in FIG. 2. The third limit switch 28*c* outputs an angle detection signal indicating an angle of 90° of the kneading arm 2 when the kneading arm 2 is turned through 90° in the clockwise direction in FIG. 2.

The angle detection signals each to be outputted from the first limit switch 28*a*, the second limit switch 28*b*, and the third limit switch 28*c*, of the second shaft detector 28, are to be outputted as a reference signal indicating an absolute angle of the kneading arm 2. The angle detection signal of the second shaft detector 28 is used to correct a rotation angle calculated from a count value of pulse signals outputted from the second pulse generator 24 in accordance with a rotation angle of the second pivot motor 22.

When the discharge port 27 is positioned in a central portion of the molding flask 3, a rotational position of the kneading arm 2 is set as an original point position, and then the second shaft detector 28 may be set to turn on any one of the first limit switch 28*a*, the second limit switch 28*b*, and the third limit switch 28*c*, when a rotational position of the kneading arm 2 reaches the original point position. This enables the central portion of the molding flask 3 where the discharge port 27 frequently passes through during molding operation to be set as the original point position of the kneading arm 2. As a result, rotation angle data on the kneading arm 2 based on a count value of pulse signals outputted from the second pulse generator 24 can be corrected with high frequency by using an angle detection signal of the second shaft detector 28, and thus accuracy of the rotation angle data on the kneading arm 2 can be increased.

The self-hardening molding apparatus 100 configured as above includes the programmable logic controller 30. The programmable logic controller 30 serves as the teaching storage means for performing the teaching storage operation of storing teaching data indicating operation and movement of an apparatus, a device, and the like in a series of molding operation in the storage unit 35 by performing teaching of molding operation when a veteran technician or the like performs the molding operation. In addition, the programmable logic controller 30 serves as the molding playback means for reading out the teaching data at the time of playback operation to perform the molding playback operation that automatically performs the series of molding operation. Thus, the programmable logic controller 30 has a teaching function and a playback function.

When a veteran technician performs teaching operation of molding operation by manually moving the conveyor arm 1 and the kneading arm 2 with the horizontal biaxial oscillation mechanism to throw kneaded self-hardening foundry sand from the discharge port 27 at the leading end of the kneading arm 2 into the molding flask 3, the programmable logic controller 30 calculates and records position data on the discharge port 27 on the basis of signals from the first pulse generator 14, the first shaft detector 18, the second pulse generator 24, and the second shaft detector 28. Then, the programmable logic controller 30 stores teaching data including movement locus data for the position data on the discharge port 27 in the storage unit 35 as a sequence control program of molding operation of a self-hardening mold. The teaching operation includes operation, movement, and the like, to be performed in an apparatus and a device, etc. in the series of molding operation.

The term, "manually" is a concept including a person's action of moving various objects by hand along with that of an operator's manual operation of a switch board 46 such as the control panel 45 for moving the horizontal biaxial oscillation mechanism to move the discharge port 27.

In addition, the programmable logic controller 30 reads out the sequence control program recorded by the teaching storage means from the storage unit 35 at the time of playback operation. The programmable logic controller 30 operates to automatically reproduce molding operation of a self-hardening mold by controlling and driving the first pivot motor 12 and the second pivot motor 22 on the basis of the sequence control program read out to allow foundry sand to be thrown while moving the discharge port 27 in accordance with a movement locus of the discharge port 27, acquired by teaching.

As described above, the microcomputer 31 of the programmable logic controller 30 counts pulse signals outputted from the first pulse generator 14 or the second pulse generator 24 from a starting point at which angle detection signals each indicating an absolute position to be outputted from the first shaft detector 18 and the second shaft detector 28 are generated, thereby calculating a rotation angle of the conveyor arm 1 or the kneading arm 2. This corrects an error of rotation angle data in accordance with pulse signals outputted from the first pulse generator 14 or the second pulse generator 24 to prevent accumulation of errors.

Figure 3:
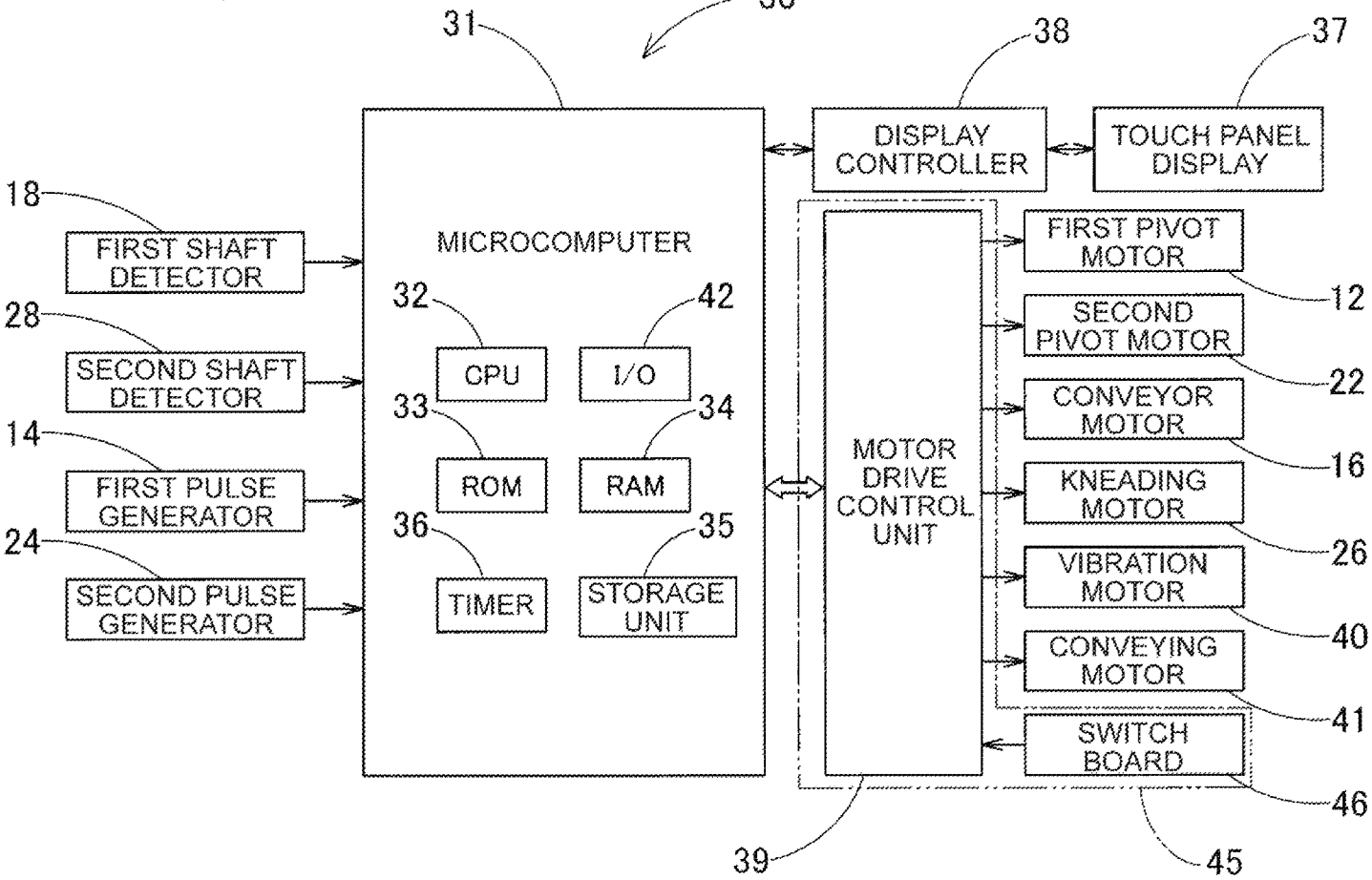
FIG. 3 is a block diagram showing a configuration of a control panel of the self-hardening molding apparatus.

As shown in FIG. 3, the microcomputer 31 constituting a main section of the programmable logic controller 30 includes a CPU 32 for executing various kinds of processing on the basis of basic program data, a ROM 33 for storing the basic program data, a RAM 34 for constituting a working area and the like of the CPU 32, an input-output circuit 42 for inputting and outputting various signals, and a timer 36 for counting time.

In addition, the microcomputer 31 includes the storage unit 35 that stores the sequence control program of molding operation stored at the time of the teaching storage operation. The storage unit 35, for example, includes a hard disk, a memory card, and a memory chip. The programmable logic controller 30 including the microcomputer 31 operates to sequentially store teaching data in accordance with molding operation to create and store the sequence control program of the series of molding operation. In addition, the programmable logic controller 30 operates to read out the sequence control program to reproduce the series of molding operation at the time of playback operation (at the time of reproduction).

As shown in FIG. 3, the microcomputer 31 of the programmable logic controller 30 performing this kind of processing is connected on signal input side to a first shaft detector 18 for detecting a pivot angle of the first pivot 11 of the conveyor arm 1, the second shaft detector 28 for detecting a pivot angle of the second pivot 21 of the kneading arm 2, the first pulse generator 14 for generating a pulse signal in accordance with a rotation angle of a rotation shaft of the first pivot motor 12, and the second pulse generator 24 for generating a pulse signal in accordance with a rotation angle of a rotation shaft of the second pivot motor 22, described above. In addition, the microcomputer 31 is connected to the touch panel display 37 through a display controller 38. The touch panel display 37 is attached to a case surface of the programmable logic controller 30.

Figure 7:
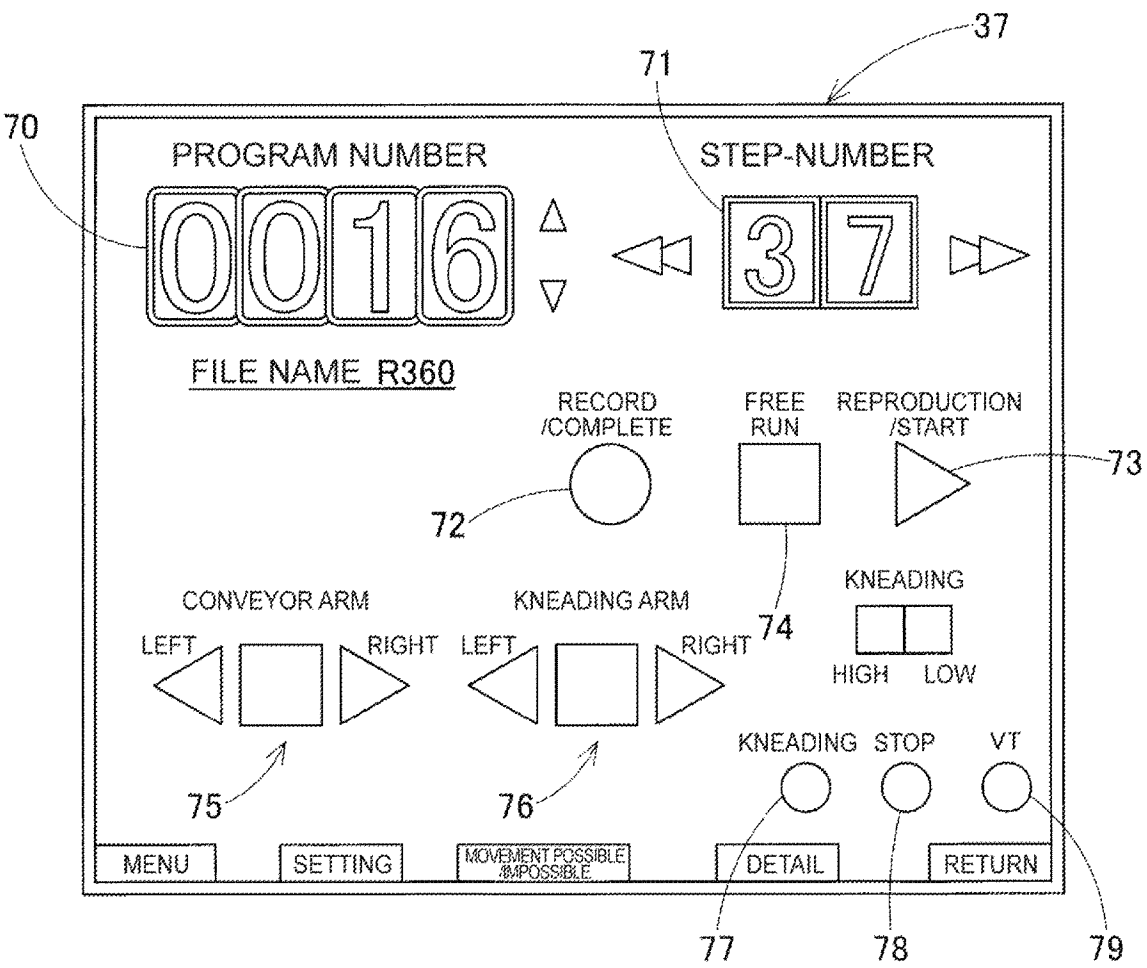
FIG. 7 illustrates a display screen of a touch panel display.

As shown in FIG. 7, the touch panel display 37 includes display areas such as: a program number display area 70 for displaying the program number of the sequence control program stored at the time of the teaching storage operation; a steps-number display area 71 for displaying the number of steps of the program; a record/complete switch display area 72 for displaying a record/complete switch that is to be operated to store data at the time of the teaching storage operation; a reproduction/start switch display area 73 for displaying a reproduction/start switch that is to be operated to perform playback at the time of the playback operation; a free-run switch display area 74 for displaying a free-run switch that is used to allow an operator to freely move the arms other than the teaching and playback operation; a switch display area 75 for displaying a switch for turning the conveyor arm 1 to the right and left; a switch display area 76 for displaying a switch for turning the kneading arm 2 to the right and left; a knead switch display area 77 for displaying a knead switch for kneading foundry sand; a stop switch display area 78 for displaying a stop switch for stopping kneading the foundry sand; and a vibration switch display area 79 for displaying a vibration switch for vibrating the vibratory table 5. The display areas 70 to 79 described above displayed in the touch panel display 37 include a portion that can be switched by touch operation.

As described above, a driving system of the self-hardening molding apparatus 100 uses the following: the first pivot motor 12 for pivoting the conveyor arm 1; the second pivot motor 22 for pivoting the kneading arm 2; the conveyor motor 16 for driving the screw conveyor 15; the kneading motor 26 for driving the kneading screw 25; the vibration motor 40 for vibrating the vibratory table 5; and the conveying motor 41 for moving the carriage 7. As shown in FIG. 3, a motor drive control unit 39 for controlling and driving these motors is provided in the control panel 45. The switch board 46 (see FIG. 4) is provided in a front face of the control panel 45.

Figure 4:
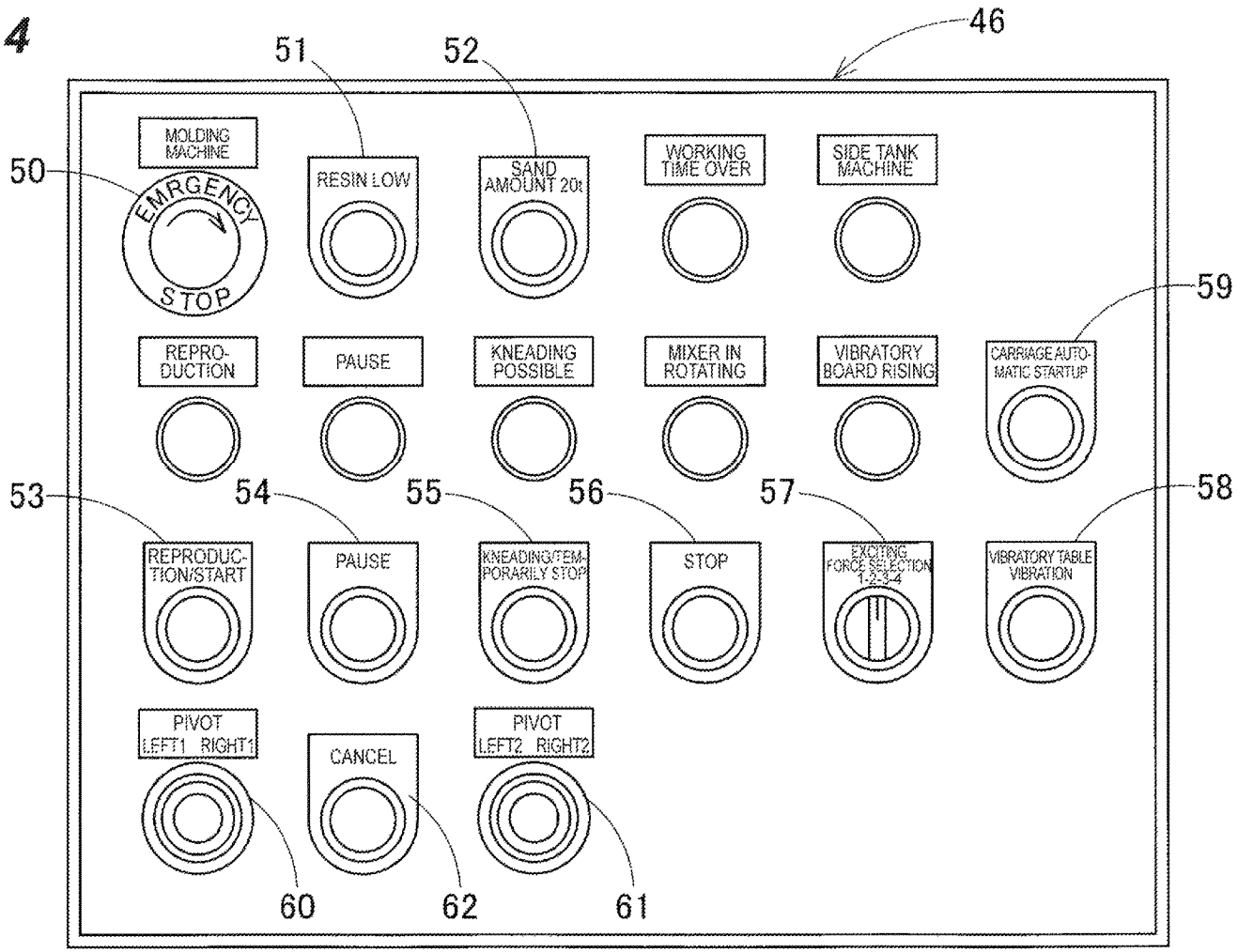
FIG. 4 shows a surface of the control panel.

As shown in FIG. 4, the switch board 46 of the control panel 45 includes switches such as: an emergency stop switch 50; a resin supply amount switch 51 for varying the supply amount of a hardener and a binder; a sand amount switch 52 for varying the throwing amount of foundry sand; a reproduction/start switch 53 to be turned on at the time of the playback operation: a pause switch 54 for pausing playback; a kneading/temporarily stop switch 55 for performing kneading in the kneading arm 2; a stop switch 56 for stopping kneading; a changeover switch 57 for changing a level of exciting force at the time of vibrating the vibratory table 5; a vibratory table switch 58 for vibrating the vibratory table 5; an automatic startup switch 59 for moving the carriage 7; a pivot switch 60 for pivoting the conveyor arm 1; a pivot switch 61 for pivoting the kneading arm 2; and a cancel switch 62 for stopping pivoting of the conveyor arm 1 or the kneading arm 2, as well as a display lamp that lights when the switches are switched. These switches are switched at the time of the teaching storage operation of molding operation, as well as at the time of the playback operation of molding operation, as with the switches displayed in the touch panel display 37 of the programmable logic controller 30.

In addition, as shown in FIG. 3, the motor drive control unit 39 is provided in the control panel 45. The motor drive control unit 39 is connected to the first pivot motor 12, the second pivot motor 22, the conveyor motor 16, the kneading motor 26 of the kneading arm 2, the vibration motor 40 of the vibratory table 5, and the conveying motor 41 of the carriage 7. Operating the switches disposed in the switch board 46 of the control panel 45 enables the motors described above to be started up and stopped. In addition, the motors described above also can be started up and stopped by operating the switches displayed in the areas in the touch panel display 37 of the programmable logic controller 30 by touch operation, the areas including: the record/complete switch display area 72; the reproduction/start switch display area 73; the free run switch display area 74; the switch display area 75 for the conveyor arm 1; the switch display area 76 for the kneading arm 2; the knead switch display area 77 for kneading of foundry sand; the stop switch display area 78; the vibration switch display area 79 for the vibratory table 5; and the like.

Figure 5:
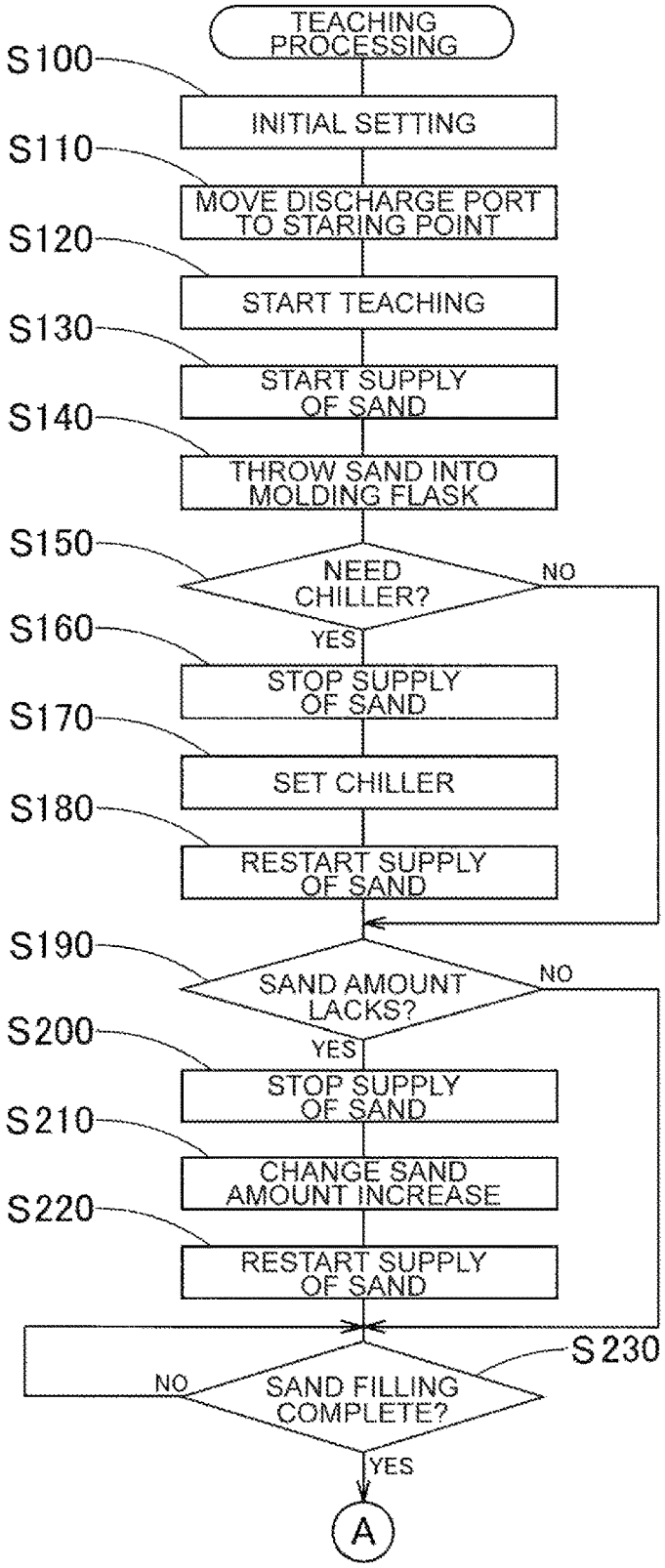
FIG. 5 is a flow chart of teaching processing of the self-hardening molding apparatus.
Figure 6:
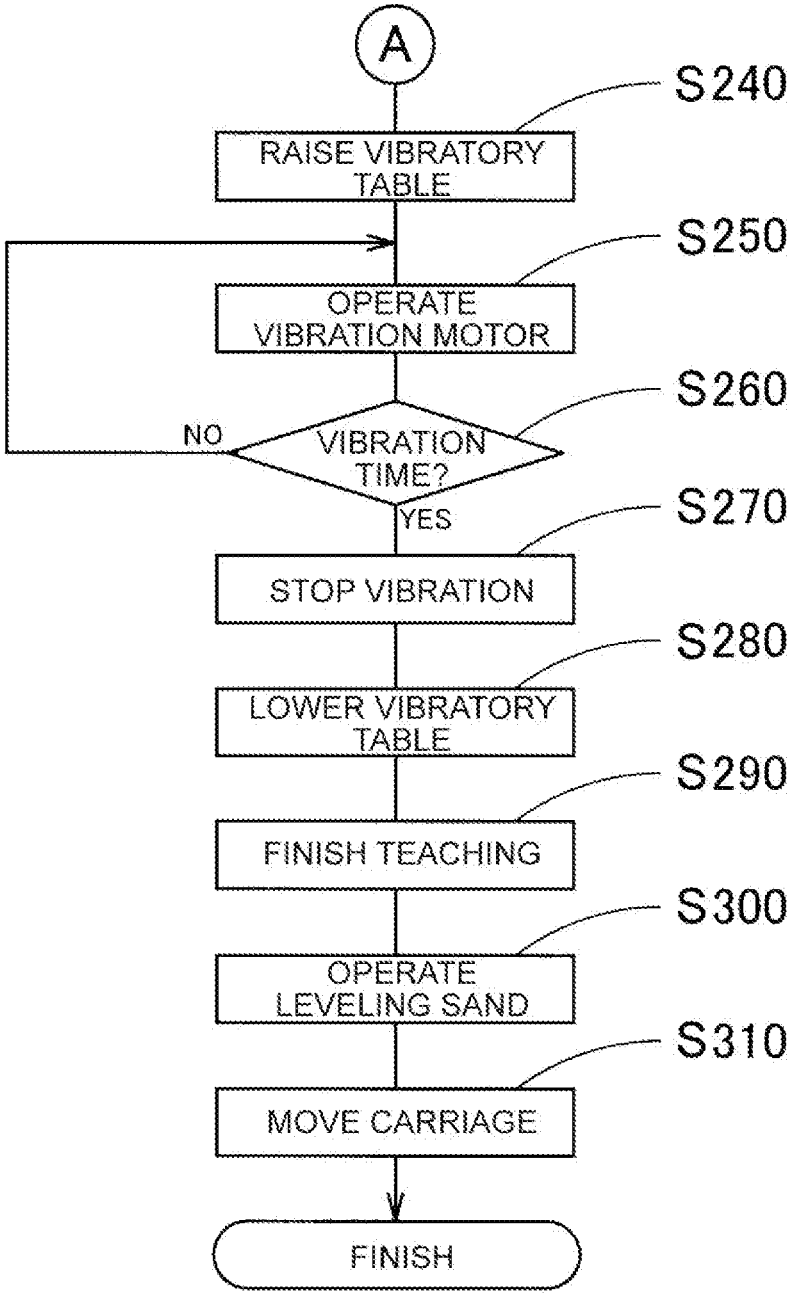
FIG. 6 is a flow chart of teaching processing of the self-hardening molding apparatus.

Next, teaching processing at the time of the molding operation in the self-hardening molding apparatus 100 configured as above will be described with reference to flow charts shown in FIGS. 5 and 6.

When teaching of the molding operation is performed, an operator such as a veteran technician of molding first manually performs initial setting of the self-hardening molding apparatus 100 in step S100. In the initial setting, the resin supply amount switch 51 in the switch board 46 of the control panel 45 is operated to be set as high or low (a level of the supply amount of the hardener and the binder). The operator also operates the sand amount switch 52 to set the supply amount of the foundry sand to 10 t or 20 t. In addition, the operator operates the changeover switch 57 for exciting force to change a level of exciting force of vibration of the vibratory table 5 in a range of 1 to 4 levels to set the level.

Subsequently, in step S110, the operator operates the pivot switch 60 for the conveyor arm 1 or operates a switch displayed in the switch display area 75 for the conveyor arm 1 in the touch panel display 37 by touch operation to pivot the conveyor arm 1 in a free-run state around the first pivot 11. The operator also operates the pivot switch 61 for the kneading arm 2 or operates a switch displayed in the switch display area 76 for the kneading arm 2 in the touch panel display 37 by touch operation to pivot the kneading arm 2 in a free-run state around the second pivot 21. The operation above moves the discharge port 27 provided at the leading end of the kneading arm 2 to a teaching starting position above the molding flask 3.

Subsequently, in step S120, the operator operates the record/complete switch displayed in the record/complete switch display area 72 in the touch panel display 37 by touch operation. This starts a recording mode of teaching operation and a display lamp for recording starts to blink. After that, recording of the teaching operation is started and the display lamp starts to continuously light. Then, the operator operates the kneading/temporarily stop switch 55 and the like to start the teaching operation of the molding operation. This allows the foundry sand to be supplied to the kneading arm 2 from the conveyor arm 1 (step S130). Next, the foundry sand fed into the kneading arm 2 is kneaded while the hardener and the binder are contained in the kneading arm 2, and then are thrown from the discharge port 27 provided at the leading end of the kneading arm 2 into the molding flask 3 below (step S140).

During the teaching storage operation in accordance with such the molding operation, the programmable logic controller 30 records an operation event of the molding operation with time every step where the conveyor motor 16, the kneading motor 26, and the like, are started up, as well as every step where the discharge port 27 provided at the leading end of the kneading arm 2 moves. If the operation event is a movement event where the discharge port 27 moves, the programmable logic controller 30 counts pulse signals outputted from the first pulse generator 14 that detects a rotation angle of the first pivot 11, and pulse signals outputted from the second pulse generator 24 that detects a rotation angle of the second pivot 21 to calculate moved position data indicating a position of the discharge port 27 that has moved in the movement event above. The programmable logic controller 30 records the calculated moved position data every step with time in the storage unit 35.

Subsequently, in step S150, the operator determines whether to put a chiller into the molding flask 3. If the chiller needs to be set (YES at step S150), the operator stops the kneading motor 26 of the kneading arm 2 to stop supply of the foundry sand into the molding flask 3 (step S160). Then, the operator sets the chiller in the molding flask 3 in this state (step S170), and restarts the kneading motor 26 of the kneading arm 2 to restart supply of the foundry sand from the kneading arm 2 (step S180).

Subsequently, in step S190, the operator determines whether the amount of the foundry sand thrown into the molding flask 3 is sufficient. If the amount of the foundry sand in the molding flask 3 is insufficient (YES at step S190), the operator operates the kneading/temporarily stop switch 55 and the like to stop the kneading motor 26 to temporarily stop throwing the foundry sand (step S200). Then, the operator operates the sand amount switch 52 and the like to increase the supply amount of the foundry sand to change the supply amount of the foundry sand to 20 t, for example (step S210). The operator then restarts the kneading motor 26 to restart supply of the foundry sand into the molding flask 3 (step S220).

Next, in step S230, the operator determined whether filling the molding flask 3 with the foundry sand is completed. If filling with the foundry sand is completed (step S230: YES), the operator operates a lifting switch and the like in the switch board 46 to move the lift 6 to raise the vibratory table 5, thereby bringing the vibratory table 5 into contact with a lower surface of the pattern 4 (step S240). The operator then operates the vibratory table switch 58 to start up the vibration motor 40 to vibrate the molding flask 3 (step S250). This allows the foundry sand in the molding flask 3 to be vibrated to increase density of the foundry sand, thereby achieving dense filling. The vibration motor 40 vibrates the molding flask 3 until a predetermined vibration time elapses (NO at step S260). When the predetermined vibration time elapses (YES at step S260), the operator stops the vibration motor 40 to stop vibrating the vibratory table 5 (step S270). The operator then moves the lift 6 to lower the vibratory table 5 to allow the vibratory table 5 to be away from the lower surface of the pattern 4 (step S280).

Subsequently, the operator operates the record/complete switch displayed in the record/complete switch display area 72 in the touch panel display 37 by touch operation to finish the teaching operation (step S290). At this time, the microcomputer 31 stores teaching data on the molding operation that has been sequentially stored in the storage unit 35 in the present teaching operation in an area of a designated program number, as a sequence control program.

Next, in step S300, the operator levels the foundry sand in the molding flask 3 to level a surface of the foundry sand. In subsequent step S310, the operator turns on the automatic startup switch 59 for the carriage 7 to move the carriage 7. This allows the carriage 7 on which the molding flask 3 and the pattern 4 are placed to be conveyed from a molding position to a predetermined place, and then a series of operation of molding of a self-hardening mold is finished. Such the teaching data on a series of molding operation performed by the operator such as a veteran technician is stored in the storage unit 35 such as a memory card along with a program number and a file name.

Figure 9:
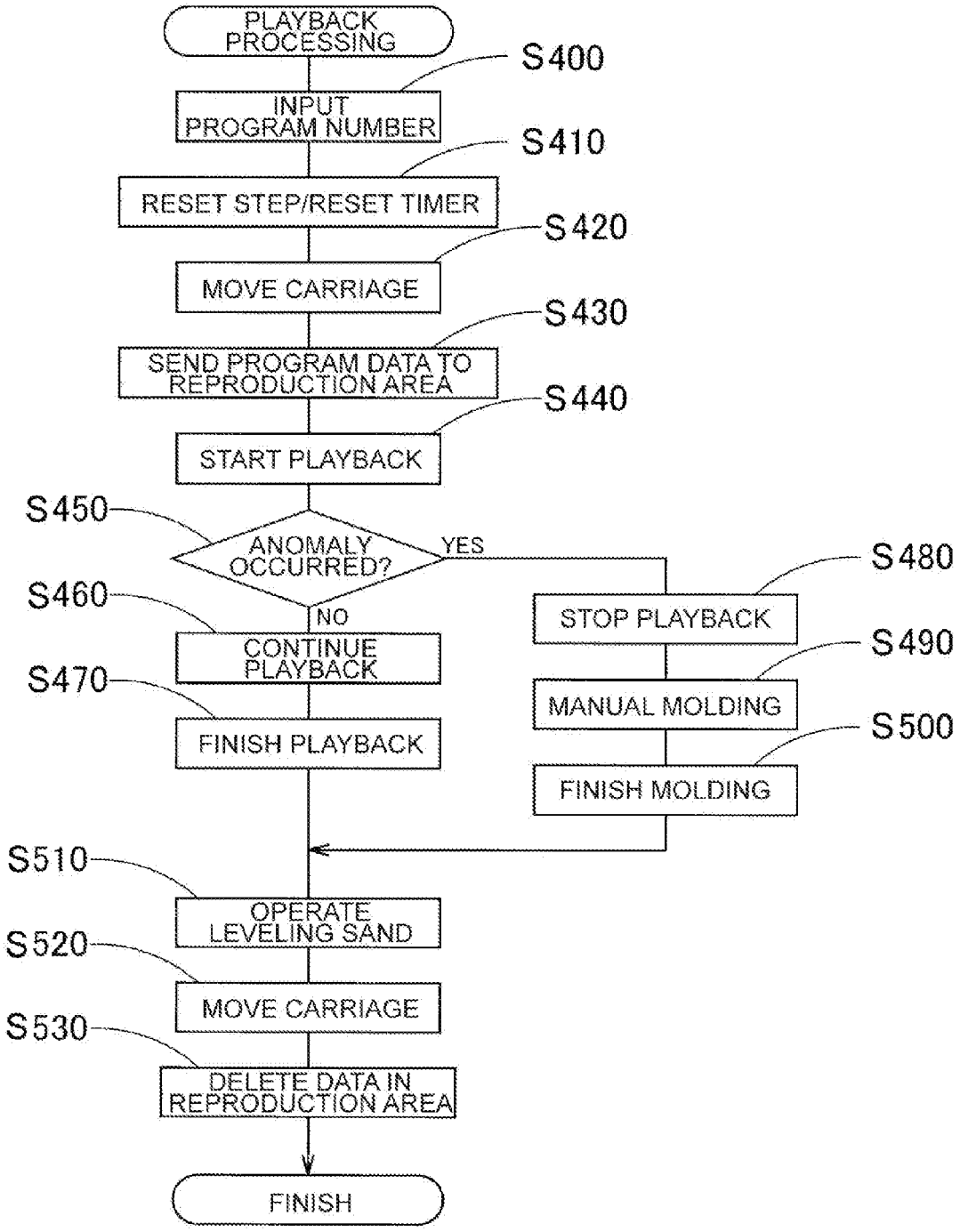
FIG. 9 is a flow chart of playback processing of the self-hardening molding apparatus.

Meanwhile, when playback (reproduction) of the molding operation is performed by using the teaching data (sequence control program) stored in storage unit 35 in accordance with the teaching operation above, as shown in a flow chart of FIG. 9, the programmable logic controller 30 controls operation of molding of a self-hardening mold to be automatically performed.

First, in step S400, the operator inputs a program number of a sequence control program of molding operation intended for playback (reproduction) into the touch panel display 37 of the programmable logic controller 30. Then, in step S410, the operator operates the touch panel display 37 to reset the number of steps to zero and to set a timer to zero.

Subsequently, in step S420, the operator operates the automatic startup switch 59 for the carriage 7 in the switch board 46 of the control panel 45 to move the carriage 7 to move the molding flask 3 and the pattern 4 to a predetermined molding position. Next, in step S430, the microcomputer 31 of the programmable logic controller 30 reads out the sequence control program of the inputted program number from the storage unit 35 to set the sequence control program in a reproduction area in the RAM 34. Then, in step S440, the microcomputer 31 starts playback (reproduction) of the molding operation.

When the playback is started, the movement of every event stored during the teaching storage operation is played back to allow the conveyor arm 1 to turn to the right and left around the first pivot 11 by operation of the first pivot motor 12, as well as the kneading arm 2 to turn to the right and left around the second pivot 21 by operation of the second pivot motor 22. This allows a position of the discharge port 27 provided at the leading end of the kneading arm 2 in the molding flask 3 to be sequentially changed in accordance with the movement locus of the discharge port 27 stored during the teaching storage operation.

During the playback, the foundry sand is fed to the kneading arm 2 from the inside of the conveyor arm 1 by rotational drive of the conveyor motor 16, and the kneading screw 25 is rotated by rotation of the kneading motor 26 of the kneading arm 2 to knead the foundry sand in the kneading arm 2 together with the hardener and the binder supplied into the kneading arm 2. The kneaded foundry sand is thrown from the discharge port 27 provided at the leading end of the kneading arm 2 into each portion in the molding flask 3 in accordance with movement of the discharge port 27.

At this time, the operator determines whether to put a chiller into the molding flask 3, and if the chiller needs to be set, the operator stops the kneading motor 26 of the kneading arm 2 to stop supply of the foundry sand into the molding flask 3, as with steps S160 to S180 during the teaching storage operation above. Subsequently, the operator sets the chiller in the molding flask 3 in this state, and then restarts the kneading motor 26 of the kneading arm 2 to supply the foundry sand from the kneading arm 2.

During the operation, the operator determines whether there is an anomaly (step S450). If there is no anomaly (NO at step S450), the operator continues the playback operation (step S460). When all steps of the sequence control program of the program number are reproduced, the microcomputer 31 finishes reproduction of the molding operation (step S470).

Meanwhile, in step S450, if the operator determined that there is an anomaly in operation of throwing the foundry sand into the molding flask 3 (YES at step S450), the operator operates the control panel 45 or the programmable logic controller 30 to stop the playback operation (step S480). This stops rotational movement of the conveyor arm 1 and the kneading arm 2 to stop supply of the foundry sand into the molding flask 3.

After that, the operator manually operates the control panel 45 or the programmable logic controller 30 to throw the foundry sand into the molding flask 3 while manually moving the discharge port 27 provided at the leading end of the kneading arm 2, thereby manually performing the molding operation (step S490). Then, when supply of the foundry sand is completed, as with steps S240 to S280 above, the operator operates the lifting switch and the like in the switch board 46 to move the lift 6 to raise the vibratory table 5, thereby bringing the vibratory table 5 into contact with the lower surface of the pattern 4.

Next, the operator operates the vibratory table switch 58 to start up the vibration motor 40 to vibrate the molding flask 3 to vibrate the foundry sand inside the molding flask 3, thereby increasing density of the foundry sand to achieve dense filling. Then, when a predetermined vibration time elapses, the operator stops the vibration motor 40 to stop vibration of the vibratory table 5, and then moves the lift 6 to lower the vibratory table 5 to allow the vibratory table 5 to be away from the lower surface of the pattern 4. This finishes the molding operation using the self-hardening foundry sand (step S500).

In this state, the operator then levels the foundry sand in the molding flask 3 (step S510) to level a surface of the foundry sand. After that, the operator operates the switch board 46 of the control panel 45 to move the carriage 7 from the molding position (step S520) to convey the molding flask 3 and the pattern 4 after the molding is finished to a predetermined place. At this point, the microcomputer 31 of the programmable logic controller 30 deletes the program data in the reproduction area in the RAM 34 (step S530) to finish the molding operation.

As described above, during the molding operation by using self-hardening foundry sand, the self-hardening molding apparatus 100 in accordance with the present embodiment calculates a rotation angle of the conveyor arm 1 by counting pulse signals outputted from the first pulse generator 14 from a starting point at which an angle detection signal to be outputted from the first shaft detector 18 is generated when the first pivot 11 of the conveyor arm 1 is rotated, and calculates a rotation angle of the kneading arm 2 by counting pulse signals outputted from the second pulse generator 24 from a starting point at which an angle detection signal to be outputted from the second shaft detector 28 is generated when the second pivot 21 of the kneading arm 2 is rotated, thereby performing the teaching storage operation or the molding playback operation. This allows the conveyor arm 1 or the kneading arm 2 to be pivoted to move the discharge port 27 to correct rotation angle data in accordance with the pulse signal outputted from the first pulse generator 14 or the second pulse generator 24 every time when the angle detection signal to be outputted from the first shaft detector 18 or the second shaft detector 28 is generated. As a result, an error in position control of the discharge port 27 is not accumulated for each rotation of the conveyor arm 1 or the kneading arm 2 unlike a conventional one, and thus the molding operation can be accurately and properly reproduced on the basis of the teaching data stored during the teaching storage operation.

Figure 8:
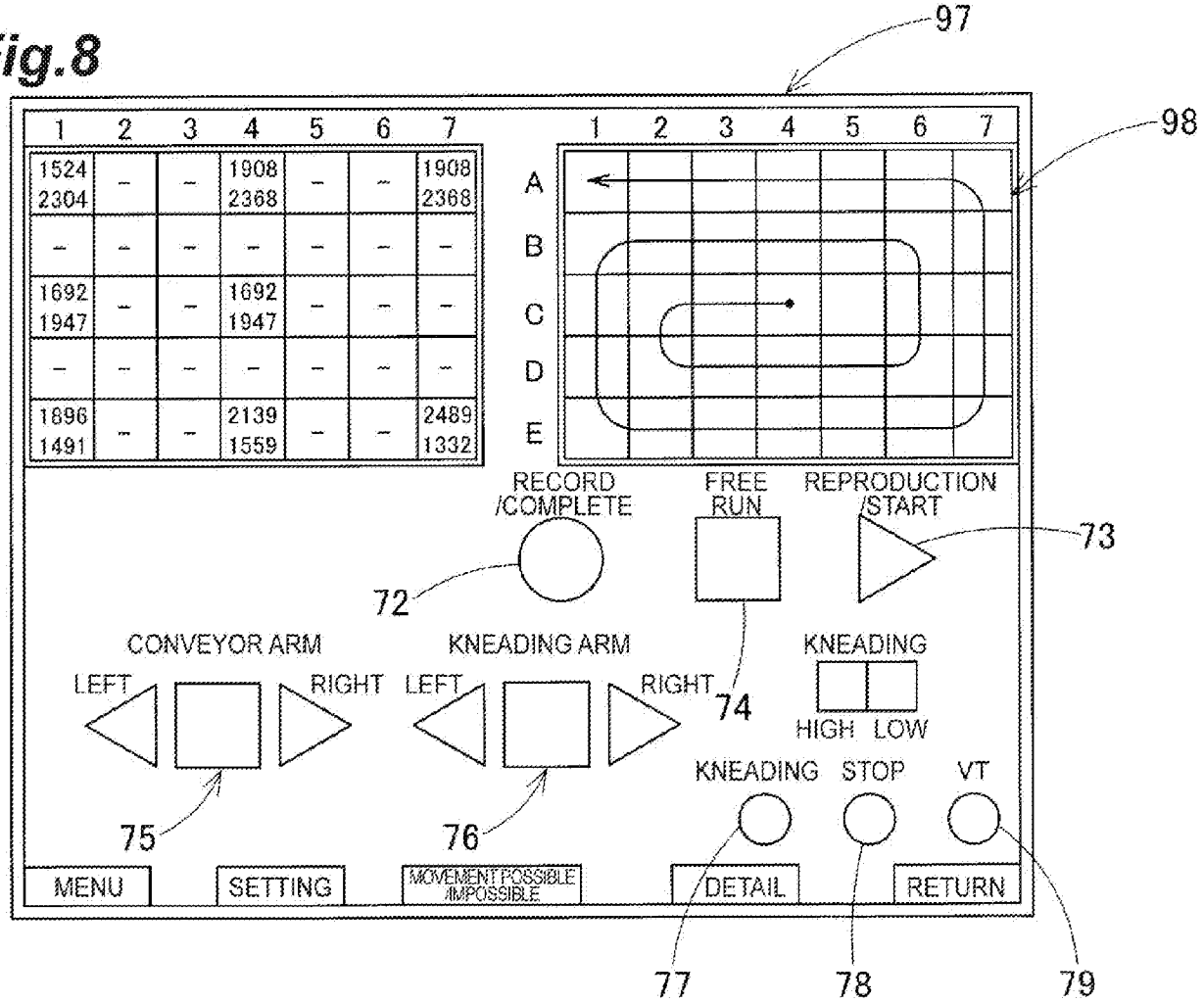
FIG. 8 illustrates a display screen of a touch panel display, the display screen showing movement of a discharge port in predetermined XY-coordinates.

FIG. 8 illustrates the touch panel display 97 of the programmable logic controller 30 of another embodiment.

In this other embodiment, XY-coordinates (rectangular coordinates) is set in the molding flask 3 that is a range of movement of the discharge port 27, and coordinates of each segment are displayed by a numeric value on a left side in an upper stage in the touch panel display 97. In addition, a locus display 98 is provided on a right side in the upper stage in the touch panel display 97. The locus display 98 is configured to display a movement locus in which the discharge port 27 moves during the teaching storage operation in plane coordinates of the molding flask 3.

The programmable logic controller 30 stores teaching polar coordinates data in the storage unit 35 as a sequence control program of the molding operation, the data indicating moved positions of the discharge port 27 by using polar coordinates on the basis of signals from the first pulse generator 14, the first shaft detector 18, the second pulse generator 24, and the second shaft detector 28, during the teaching storage operation. Then, the programmable logic controller 30 reproduces the molding operation on the basis of the teaching polar coordinates data on the discharge port 27, stored in the storage unit 35, during the molding playback operation.

In addition, the microcomputer 31 of the programmable logic controller 30 sets XY-coordinates (rectangular coordinates) in the molding flask 3 that is a range in which the discharge port 27 provided at the leading end of the kneading arm 2 moves with movement of a horizontal biaxial oscillation mechanism. The microcomputer 31 then converts the teaching polar coordinates data on moved positions of the discharge port 27 into XY-coordinates to output the data to the touch panel display 97 as display means. This allows coordinates of the moved positions of the discharge port 27 to be displayed in the touch panel display 97.

In such the other embodiment, during the teaching storage operation or the playback operation, a movement locus of the discharge port 27 is graphically displayed in the locus display 98 in XY-coordinates displayed in the touch panel display 97 on the basis of the teaching polar coordinates data converted into XY-coordinates. Thus, an operator can easily visually recognize movement of the discharge port 27 in the molding operation during teaching storage operation or reproduced operation while viewing the graphic display.

As described above, the self-hardening molding apparatus 100 in accordance with the embodiment of the present invention is capable of accurately reproducing molding operation on the basis of teaching data stored during teaching storage operation. In addition, the drive control system uses the first pivot motor 12, the second pivot motor 22, the first pulse generator 14, the second pulse generator 24, and the like, and thus the molding apparatus can be manufactured at low cost as compared with a conventional device.

REFERENCE SIGNS LIST

1 . . . conveyor arm, 2 . . . kneading arm, 3 . . . molding flask, 4 . . . pattern, 5 . . . vibratory table, 6 . . . lift, 7 . . . carriage, 10 . . . pivot support part, 11 . . . first pivot, 12 . . . first pivot motor, 13 . . . sand hopper, 14 . . . first pulse generator, 15 . . . screw conveyor, 16 . . . conveyor motor, 18 . . . first shaft detector, 18*a* . . . first limit switch, 18*b* . . . second limit switch, 18*c* . . . third limit switch, 21 . . . second pivot, 22 . . . second pivot motor, 24 . . . second pulse generator, 25 . . . kneading screw, 26 . . . kneading motor, 27 . . . discharge port, 28 . . . second shaft detector, 28*a* . . . first limit switch, 28*b* . . . second limit switch, 28*c* . . . third limit switch, 30 . . . programmable logic controller, 31 . . . microcomputer, 32 . . . CPU, 33 . . . ROM, 34 . . . RAM, 35 . . . storage unit, 36 . . . timer, 37 . . . touch panel display, 38 . . . display controller, 39 . . . motor drive control unit, 40 . . . vibration motor, 41 . . . conveying motor, 42 . . . input-output circuit, 45 . . . control panel, 46 . . . switch board, 50 . . . emergency stop switch, 51 . . . resin supply amount switch, 52 . . . sand amount switch, 53 . . . reproduction/start switch, 54 . . . pause switch, 55 . . . kneading/temporarily stop switch, 56 . . . stop switch, 57 . . . changeover switch, 58 . . . vibratory table switch, 59 . . . automatic startup switch, 60 . . . pivot switch, 61 . . . pivot switch, 62 . . . cancel switch, 70 . . . program number display area, 71 . . . step-number display area, 72 . . . record/complete switch display area, 73 . . . reproduction/start switch display area, 74 . . . free run switch display area, 75 . . . switch display area, 76 . . . switch display area, 77 . . . knead switch display area, 78 . . . stop switch display area, 79 . . . vibration switch display area.

The invention claimed is:

1. A self-hardening molding apparatus that throws self-hardening foundry sand kneaded by adding a hardener and a binder into foundry sand into a molding flask so that the molding flask is filled with the self-hardening, foundry sand to be hardened to form a mold, the self-hardening molding apparatus comprising:

a conveyor arm that is pivotally supported around a pivot and has a conveyor for feeding the foundry sand;

a first pivot motor that pivotally drives the conveyor arm;

a first pulse generator that generates a pulse signal in accordance with rotation of the first pivot motor;

a first shaft detector that includes a plurality of detection switches each being associated with a pivot angle and being configured to generate an angle detection signal indicating the pivot angle when the conveyor arm is pivoted by the pivot angle;

a kneading arm that is pivotally attached around a pivot at a leading end of the conveyor arm to receive the foundry sand fed by the conveyor in the conveyor arm, and that feeds the foundry sand to a leading end of the kneading arm while kneading the foundry sand together with the hardener and the binder to discharge the kneaded self-hardening foundry sand from a discharge port provided at the leading end of the kneading arm;

a second pivot motor that pivotally drives the kneading arm with respect to the conveyor arm;

a second pulse generator that generates a pulse signal in accordance with rotation of the second pivot motor;

a second shaft detector that includes a plurality of detection switches each being associated with a pivot angle and being configured to generate an angle detection signal indicating the pivot angle when the kneading arm is pivoted by the pivot angle;

a processor configured to:

perform teaching storage operation of storing teaching data created on the basis of signals from the first pulse generator, the first shaft detector, the second pulse generator, and the second shaft detector when teaching operation of throwing the kneaded self-hardening foundry sand from the discharge port into the molding flask is performed by moving the conveyor arm and the kneading arm manually, the teaching data being stored in a storage unit as a sequence control program of molding operation of a self-hardening mold; and perform molding playback operation to perform the molding operation of a self-hardening mold by reading, out the sequence control program from the storage unit to control and drive the first pivot motor and the second pivot motor on the basis of the sequence control program, wherein the processor calculates a rotation angle of the conveyor arm or the kneading arm by counting the pulse signal outputted from the first pulse generator or the second pulse generator from a starting point at which the angle detection signal to be outputted from each of the first shaft detector and the second shaft detector is generated, thereby performing the teaching storage operation or the molding playback operation.

2. The self-hardening molding apparatus according to claim 1, wherein the plurality of detection switches of the first shaft detector and the plurality of detection switches of the second shaft detector are disposed to allow each of at least one of the plurality of detection switches of the first shaft detector and at least one of the plurality of detection switches of the second shaft detector to generate the angle detection signal when the discharge port is moved to a central portion of the molding flask.

3. The self-hardening molding apparatus according to claim 1, further comprising:

a vibratory table for vibrating the molding flask, wherein the vibratory table vibrates the molding flask while the self-hardening foundry sand is thrown from the discharge port provided at the leading end of the kneading arm during the teaching storage operation or the molding playback operation.

4. The self-hardening molding apparatus according to claim 1, wherein the processor stores teaching polar coordinates data indicating polar coordinates of moved positions of the discharge port in the storage unit as the sequence control program on the basis of signals from the first pulse generator, the first shaft detector, the second pulse generator, and the second shaft detector, during the teaching storage operation, and the processor reproduces the molding operation of a self hardening mold on the basis of the teaching polar coordinates data stored in the storage unit, during the molding playback operation.

5. The self-hardening molding apparatus according to claim 4, further comprising:

a display configured to display coordinates of moved positions of the discharge port, wherein the conveyor arm and the kneading arm are pivotally supported in a horizontal plane to form a horizontal biaxial rotation mechanism, the horizontal biaxial rotation mechanism being operated to set XY-coordinates in the molding flask being a range of movement of the discharge port, and the display displays coordinates of moved positions of the discharge port on the basis of the teaching polar coordinates data converted into the XY-coordinates.

* * * * *